United States Patent [19]

Grabarski et al.

[11] Patent Number: 4,615,241

[45] **Date of Patent: * Oct. 7, 1986**

[54] POWER DRIVEN BOTTLE OPENER

[76] Inventors: David L. Grabarski; Harvey A. Williams, both of 247 Walnut Ave., Bellmawr, N.J. 08031

[ * ] Notice: The portion of the term of this patent subsequent to May 28, 2002 has been disclaimed.

[21] Appl. No.: 738,169

[22] Filed: May 24, 1985

Related U.S. Application Data

[63] Continuation-in-part of Ser. No. 563,777, Dec. 21, 1983, Pat. No. 4,519,276.

[51] Int. Cl.[4] ..... B67B 7/18

[52] U.S. Cl. ..... 81/3.2; 81/3.33

[58] Field of Search ..... 81/3.2, 3.09, 3.33, 81/3.25, 3.4; 53/381 A, 381 R

[56] References Cited

U.S. PATENT DOCUMENTS

| | | | |
|---|---|---|---|
| 2,559,358 | 7/1951 | Hullhorst et al. | 81/3.2 |
| 2,612,065 | 9/1952 | Packer et al. | 81/3.2 |
| 4,171,650 | 10/1979 | Cardinal | 81/3.2 |
| 4,230,000 | 10/1980 | Downs | 81/3.2 |
| 4,358,970 | 11/1982 | Jacobson | 81/3.2 |
| 4,519,276 | 5/1985 | Grabarski | 81/3.2 |

FOREIGN PATENT DOCUMENTS

| | | | |
|---|---|---|---|
| 573357 | 3/1976 | Switzerland | 81/3.4 |

*Primary Examiner*—Roscoe V. Parker

*Attorney, Agent, or Firm*—Norman E. Lehrer

[57] ABSTRACT

A power driven bottle opener for removing the twist-off caps from the top of a bottle includes a housing containing an electric motor and a limit switch for starting and stopping the motor. An inverted cup-shaped head is rotated by said motor and includes ribs on its interior cylindrical wall which engage the cap for twisting the same. A cap ejector pin extends at least partially vertically through the housing and into the head and can be manually pushed downwardly from the front of the housing to eject a cap which may become lodged in the removing head. The pin also carries a radial projection which activates the limit switch and therefore the motor when the pin is moved upwardly by a bottle and cap inserted into the cap removing head.

8 Claims, 4 Drawing Figures

POWER DRIVEN BOTTLE OPENER

DESCRIPTION

CROSS-REFERENCE TO RELATED APPLICATION

This is a continuation-in-part of application Ser. No. 563,777, filed Dec. 21, 1983, now U.S. Pat. No. 4,519,276.

TECHNICAL FIELD

The present invention is directed toward a power driven bottle opener and more particularly toward a motor operated opener for removing the screw top caps from a bottle. The invention is particularly designed for the home market.

BACKGROUND ART

As is more fully explained in Applicants' parent application, a common complaint by bartenders and others serving a large amount of bottled beer, soda and other beverages is the problems encountered in unscrewing the caps thereof. This is not only very time consuming but can also be annoying and sometimes painful. Not infrequently, the caps are crimped so tightly that they are extremely difficult to unscrew and the bartender's hands can become sore and even cut when attempting to open the bottle.

Proposals have been made in the past to provide a power driven bottle cap remover for unscrewing the caps from twist top bottles. One example is shown in U.S. Pat. No. 4,358,970. Insofar as Applicants are aware, this device has not met with any success and it is believed that this is true because of the relative complexity of the device which would add to the cost of manufacture. For example, in the device shown in the patent, the entire cap removing head is mounted for both rotational and axial movement. This requires a bushing support which allows for linear movement and also a gear train which allows for linear movement.

The device shown in U.S. Pat. No. 4,358,970 also includes a relatively complex arrangement of spring loaded knives and a spring loaded plunger for ejecting a bottle cap which has been removed from a bottle. However, it is not inconceivable that the cap could become so tightly lodged that the forces needed to remove the same would exceed the spring forces of the plunger and knife springs. Increasing these spring forces, however, would make it extremely difficult to operate the device. Thus, it is possible that a cap could become lodged in the removing head.

While the invention disclosed in application Ser. No. 563,777 overcame many of the disadvantages of the prior art, it still had some limitations. The prior device includes a bracket for mounting the same on a bar whereas for home use it is desirable to mount the bottle opener under a cabinet or the like. Because the cap ejector pin of the prior device extended upwardly through the top wall thereof, such devices could not be mounted under a cabinet.

DISCLOSURE OF INVENTION

The under cabinet mounted power driven bottle opener of the invention includes a housing containing an electric motor and a limit switch for starting and stopping the motor. An inverted cup-shaped head is rotated by said motor and includes ribs on its interior cylindrical wall which engage the cap for twisting the same. A cap ejector pin extends at least partially vertically through the housing and into the head and can be manually pushed downwardly from the front of the housing to eject a cap which may become lodged in the removing head. The pin also carries a radial projection which activates the limit switch and therefore the motor when the pin is moved upwardly by a bottle and cap inserted into the cap removing head.

BRIEF DESCRIPTION OF DRAWINGS

For the purpose of illustrating the invention, there is shown in the accompanying drawings one form which is presently preferred; it being understood that the invention is not intended to be limited to the precise arrangements and instrumentalities shown.

BEST MODE FOR CARRYING OUT THE INVENTION

Figure 1:
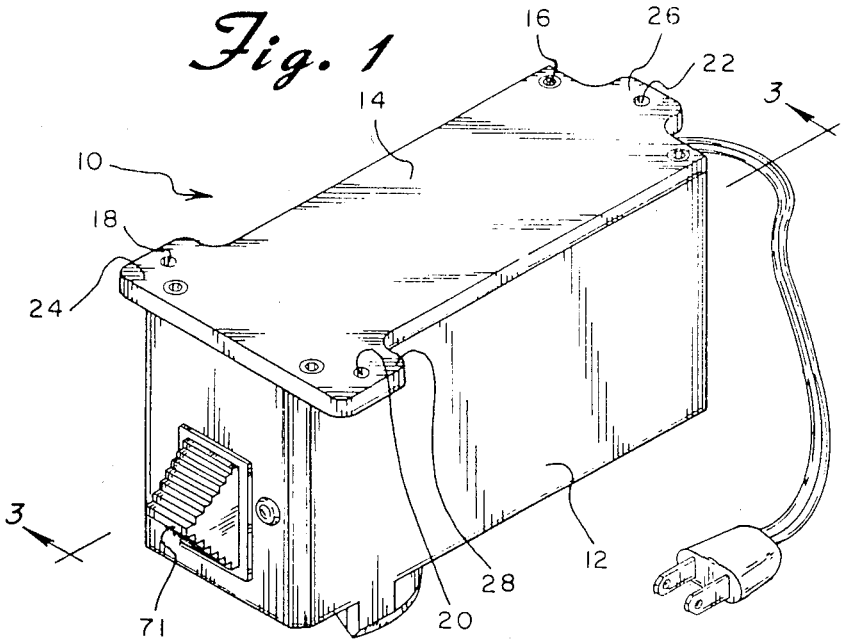
FIG. 1 is a front perspective view of a power driven bottle opener constructed in accordance with the principles of the present invention.
Figure 2:
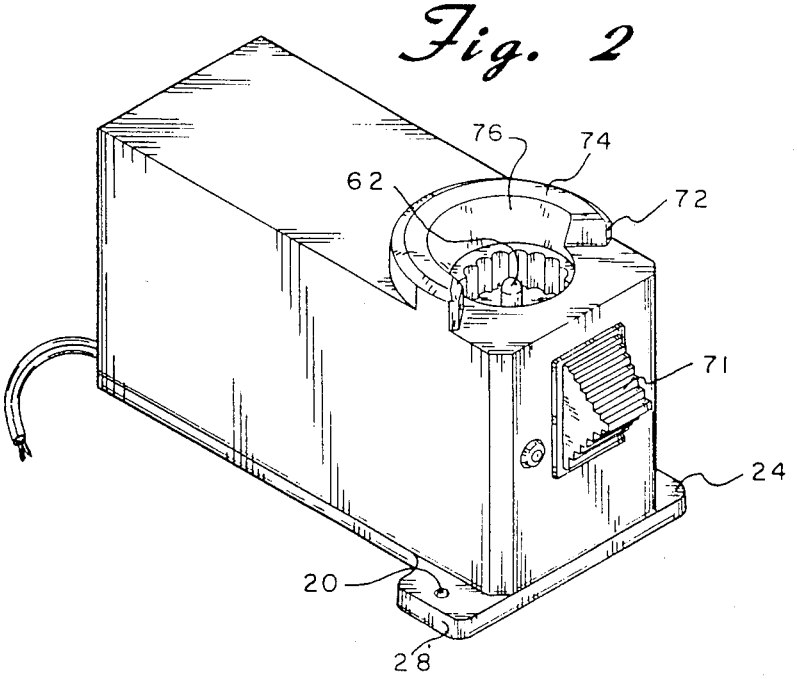
FIG. 2 is a perspective view similar to FIG. 1 but from the bottom thereof.

Referring now to the drawings in detail wherein like reference numerals have been used throughout the various figures to designate like elements, there is shown in FIGS. 1 and 2 a power driven bottle opener constructed in accordance with the principles of the present invention and designated generally as 10. Opener 10 includes a housing 12 having a cover member 14 secured to the top thereof by screws 16. The cover member 14 is intended to support and mount the entire device under a horizontal support surface such as a cabinet or the like. The bottle opener 10 is secured in place by the use of a plurality of screws passing upwardly through the openings 18, 20 and 22 in the tabs 24, 26 and 28, respectively.

Figure 3:
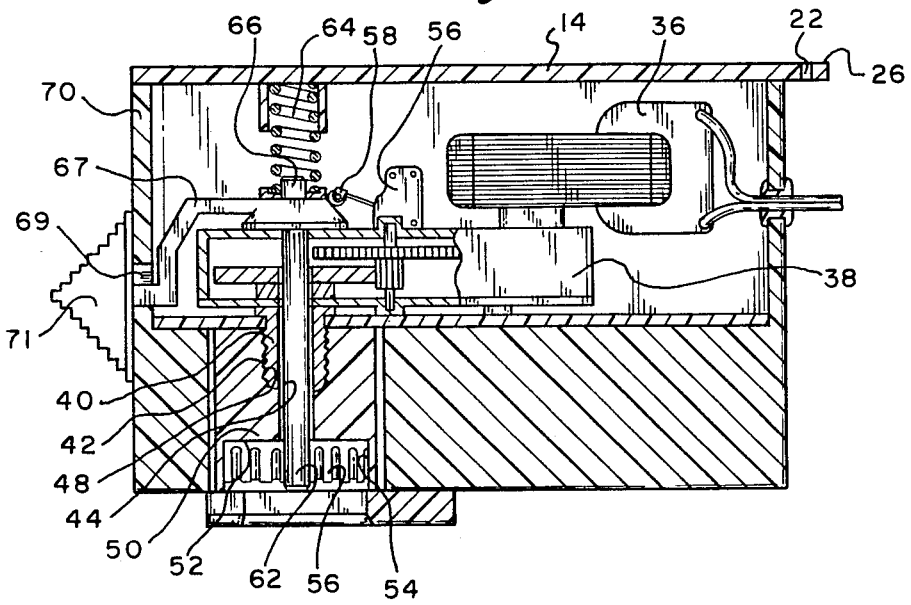
FIG. 3 is a cross-sectional view of the forward end of the bottle opener taken through the lines 3—3 of FIG. 1.
Figure 4:
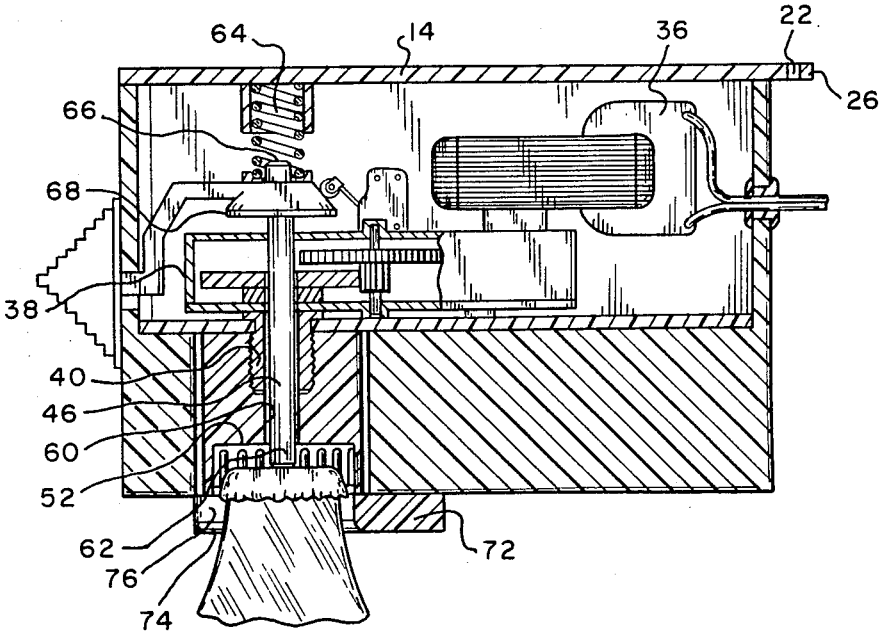
FIG. 4 is a view similar to FIG. 3 but showing the bottle opener in operation with a bottle inserted therein.

The actual bottle opening mechanism is housed in the housing 12 and is shown most clearly in FIGS. 3 and 4. This mechanism includes an electric motor 36 which is connected to a speed reduction gearbox 38. The output of the gearbox 38 is a downwardly extending driving shaft 40 which has a reverse thread 42 formed on the outer surface thereof. The shaft 40 also has a hollow center 44 formed therein as do the gear and gearbox above the shaft 40 so as to accommodate the vertically extending pin 46 which passes entirely therethrough.

Secured to the shaft 40 through the use of a reverse internal thread 48 is an inverted cup-shaped bottle cap removing head 50. Head 50 includes a top wall 52 and a substantially cylindrical side wall 54. A plurality of axially extending ribs 56 are formed on the cylindrical wall 54. These ribs are designed to engage the screw top cap of a bottle when the same is inserted into the opening of the head 50. It should be pointed out that the shaft 40 rotates only and does not move axially. Accordingly, the head 50 is mounted only for rotational movement and will not move axially or laterally.

Also mounted within the housing 20 is a limit switch 56 which functions to turn the motor 36 on and off. Switch 56 is activated by movement of the operator 58 which is spring biased in the downward position shown in FIG. 3.

The top wall 52 of the head 50 has an opening 60 therein which is in alignment with the opening 44 in the shaft 40. This allows the lower end 62 of the pin 46 to pass therethrough. Pin 46 is axially movable between the lower position shown in FIG. 3 wherein the lowermost end 62 thereof extends into the cylindrical opening in the head 52 and an upper position as shown in FIG. 4 wherein the lower end 62 is even with or is just below the top wall 52 of the head 50. Spring 64 normally biases the pin 46 into the lower position shown in FIG. 3.

Mounted on the ejector pin 46 adjacent the top 66 thereof is a radially extending projection 68. In the preferred embodiment, this projection is substantially conically shaped. The size of the projection 68 and the position of the limit switch 56 are arranged such that the operator 58 normally contacts the projection 68 when the pin 46 is in its lowermost position as shown in FIG. 3. Furthermore, the pin tends to remain downwardly in this position as it is biased downwardly by the spring tension of the spring 64. When the pin 46 is moved upwardly, however, projection 68 moves the operator 58 upwardly as shown in FIG. 4 to activate the motor 36. When the pin 46 again moves downwardly allowing the operator 58 to move downwardly, power to the motor 36 is turned off.

Rigidly secured to the projection 68 and therefore to the pin 46 is an arm 67. Arm 67 extends forwardly of the housing 12 and passes through a slotted opening 69 in the front wall 70 of the housing. A knob 71 is secured to the end of the arm 67 for movement therewith. Thus, it can be seen that manual movement of the knob 71 up or down similarly moves the pin 46 up or down.

Means are also provided for helping to guide the bottle into proper position. As shown most clearly in FIG. 2, a guide 72 fastened to the bottom of the housing 12 has a taper 74 thereon which helps to guide a bottle top approaching the opening head and in the vicinity thereof into proper alignment with the head. Furthermore, the guide also includes a semicylindrically shaped rear wall 76 which acts as a stop mechanism so that a bottle can be pushed rearwardly and an indication will be given to the operator that the bottle is in proper alignment.

The power driven bottle opener 10 of the invention works in the following manner. With the device properly supported under a cabinet or the like, a capped bottle is inserted upwardly into the opening in the head 50. As this occurs, the ejector pin 46 is moved up and the side edges of the cap are engaged by the ribs 56. Also, the radial projection 68 moves the operator 58 into its operable position whereby the switch 56 turns the motor 36 on. The motor 36 through the gearbox 38 and shaft 40 turns the head 50 in the proper direction to unscrew the cap from the bottle. After several seconds, the cap has been unscrewed and the bottle can be removed. In the unlikely event that the cap becomes lodged in the head 50, the operator will immediately know this since the motor will continue to run even when the bottle is removed. This is easily rectified, however, by merely manually pushing the knob 71 downwardly. In addition to turning off the motor 36, the lowermost end 62 of the pin 46 will force the cap out of the head 50.

The present invention may be embodied in other specific forms without departing from the spirit or essential attributes thereof and accordingly reference should be made to the appended claims rather than to the foregoing specification as indicating the scope of the invention.

We claim:

1. A power driven bottle opener comprising:

a housing and means for supporting said housing on a support surface;

electric motor means within said housing and including switch means for starting and stopping said motor means;

an inverted cup-shaped bottle cap removing head including a top wall and a substantially cylindrical side wall, said side wall including a plurality of axially extending ribs thereon for engaging the screw top cap of a bottle;

means for mounting said head and for interconnecting the same with said motor means so that said head can be rotated by said motor means, said mounting means preventing axial movement of said head;

a cap ejection pin, at least a portion of which extends vertically within said housing, said pin being substantially coaxial with said head and being mounted for limited axial movement between a lower position wherein the lower end of said pin is within said head and below the top wall thereof and an upper position wherein the lower end of said pin is closer to said top wall and means accessible from outside of said housing for manually pushing said pin downwardly when necessary to eject a removed bottle cap which may become lodged within said head.

2. A bottle opener as claimed in claim 1 including means for biasing said pin into its lower position.

3. A bottle opener as claimed in claim 1 wherein said switch means is activated by said pin when moved toward its upward position.

4. A bottle opener as claimed in claim 3 wherein said pin includes a radially extending projection and wherein said switch means includes a limit switch which is mounted within said housing so as to be engaged by said projection when said pin is moved upwardly.

5. A bottle opener as claimed in claim 1 further including means on said housing and adjacent the lower open portion of said head for guiding the top of a bottle into said head.

6. A bottle opener as claimed in claim 1 wherein said means for pushing said pin downwardly is accessible from the front of said housing.

7. A bottle opener as claimed in claim 1 wherein said means for supporting is adapted to support said housing beneath a cabinet.

8. A bottle opener as claimed in claim 7 wherein said means for supporting includes a cover for said housing having a plurality of tabs extending outwardly therefrom.

* * * * *